US006705214B1

(12) United States Patent
Stamps

(10) Patent No.: US 6,705,214 B1
(45) Date of Patent: Mar. 16, 2004

(54) AUTOMATIC COTTON BALER WITH TILT-OUT HEADS

(75) Inventor: Timothy Stamps, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 18 days.

(21) Appl. No.: 09/919,112

(22) Filed: Jul. 31, 2001

(51) Int. Cl.[7] ..... B65B 13/04

(52) U.S. Cl. ..... 100/14; 100/3; 100/26

(58) Field of Search ..... 100/3, 8, 14, 26, 100/29, 31, 32, 33 R, 33 PB

(56) References Cited

U.S. PATENT DOCUMENTS

| | | | | |
|---|---|---|---|---|
| 2,632,381 A | | 3/1953 | Buckland | |
| 2,780,986 A | | 2/1957 | Ritenour | |
| 3,070,001 A | | 12/1962 | Feldkamp | |
| 3,125,018 A | * | 3/1964 | Brouse et al. | 100/26 |
| 3,470,813 A | | 10/1969 | Nomm et al. | |
| 3,568,591 A | | 3/1971 | Dunlap | |
| 3,621,888 A | | 11/1971 | Ericsson | |
| 3,720,158 A | | 3/1973 | Sauer et al. | |
| 3,804,001 A | * | 4/1974 | Longerich et al. | 100/26 |
| 3,834,297 A | | 9/1974 | Huson | |
| 3,863,558 A | | 2/1975 | Trumbo | |
| 3,910,089 A | | 10/1975 | Meier et al. | |
| 3,921,799 A | | 11/1975 | Meier | |
| 3,935,616 A | | 2/1976 | Simmons | |
| 4,031,594 A | | 6/1977 | Cepuritis | |
| 4,048,697 A | | 9/1977 | Duenser | |
| 4,062,086 A | | 12/1977 | Wojcik | |
| 4,079,667 A | | 3/1978 | Lems et al. | |
| 4,080,689 A | | 3/1978 | Meier | |
| 4,090,440 A | | 5/1978 | Jensen | |
| 4,156,385 A | | 5/1979 | Lems et al. | |
| 4,158,994 A | | 6/1979 | Jensen | |
| 4,226,007 A | | 10/1980 | Duenser | |
| 4,228,565 A | | 10/1980 | Lems et al. | |
| 4,378,262 A | | 3/1983 | Annis, Jr. | |
| 4,391,186 A | | 7/1983 | Davis | |
| 4,403,542 A | | 9/1983 | Lewis | |
| 4,450,763 A | | 5/1984 | Saylor | |
| 4,466,535 A | | 8/1984 | Huson | |
| 4,484,518 A | | 11/1984 | Jaenson | |
| 4,501,356 A | | 2/1985 | Urban et al. | |
| 4,520,720 A | | 6/1985 | Urban et al. | |
| 4,534,817 A | | 8/1985 | O'Sullivan | |
| 4,566,378 A | * | 1/1986 | Fleissner | 100/26 |
| 4,584,935 A | | 4/1986 | Luggen | |
| 4,611,534 A | | 9/1986 | Kudlicka et al. | |
| 4,625,635 A | | 12/1986 | Lewis | |
| 4,649,812 A | | 3/1987 | Mouret | |
| 4,665,815 A | | 5/1987 | Fleissner | |
| 4,718,336 A | * | 1/1988 | Munro | 100/31 |
| 4,787,425 A | | 11/1988 | Saylor | |
| 4,951,562 A | | 8/1990 | Ribaldo | |
| 5,039,250 A | | 8/1991 | Janz | |
| 5,070,779 A | | 12/1991 | Molitorisz | |
| 5,117,536 A | | 6/1992 | Beach et al. | |
| 5,133,532 A | | 7/1992 | Figiel et al. | |

(List continued on next page.)

OTHER PUBLICATIONS

Videotape; Cranston Wire Typing; approximate date 1985; approximate length 4 minutes.
Videotape; Samuels Strapping System; Mosely Gin, Abbeville, AL; date as early as Mar. 31, 2000; approximate length 4 minutes.

*Primary Examiner*—Stephen F. Gerrity

(57) ABSTRACT

A tilt out head for a bulk material baler that includes a bracket for holding a baling wire feed drive, including an electro servo motor and drive wheels, a baling wire knotter including tying cylinders and an electro servo motor and optionally other equipment such as a cutter, a gripper, and tensioning pins. The tilt out bracket of the present invention pivots at its lower extremity so that the equipment on the bracket may rotate outwards and down away from a baler carriage to a stopped position that exposes all of the parts for ease of repair and maintenance.

16 Claims, 8 Drawing Sheets

U.S. PATENT DOCUMENTS 5,379,687 A 1/1995 Moseley
5,417,320 A 5/1995 Velan et al.
5,477,724 A 12/1995 Velan et al.
5,483,837 A 1/1996 Velan et al.
5,546,855 A 8/1996 Van Doorn et al.
5,644,978 A 7/1997 Jaenson et al.
5,673,614 A 10/1997 Jaenson et al.
5,689,934 A 11/1997 Scherer et al.
5,718,167 A * 2/1998 Renz et al. ..... 100/29
5,746,120 A 5/1998 Jonsson
5,826,499 A 10/1998 Bullington
5,870,950 A 2/1999 Weidel

* cited by examiner

AUTOMATIC COTTON BALER WITH TILT-OUT HEADS

CROSS REFERENCE TO RELATED APPLICATIONS

None

STATEMENT REGARDING FEDERALLY SPONSORED RESEARCH OR DEVELOPMENTS

Not applicable.

BACKGROUND OF THE INVENTION

1. Field of the Invention

This invention relates generally to an automatic baler for cotton or other bulk materials with tilt out heads for ease of maintenance.

2. Related Art

Automation has benefited the baling of bulk materials such as cotton by increasing speed and reducing material costs. Automated machines for baling bulk materials with wire, metal straps or plastic straps are known in the art. These machines bind standardized volumes and weights of bulk materials. The straps or wires must be propelled and guided around the circumference of a volume of bulk material. Thereafter the ends of the strap or wire must be sealed or knotted together. These tasks must be achieved while the bulk material is under compression. After the straps or wires are sealed or knotted, compression is released and the bulk material is constrained to its desired volume by the straps or wires.

These tasks are automatically achieved through the use of electro-servo motors for propulsion of wires or straps, guide tracks for guiding wires or straps, and limit switches or sensors for controlling the electro-servo motors. A separate electric-servo motor is used for knotting the ends of wires. These techniques are disclosed in detail, elsewhere, for example, in U.S. patent application Ser. No. 09/540,020 which is incorporated herein by reference. Efficient configurations for a propulsion electro-servo motor, a knotting electro-servo motor, beginning and ending termini of a guide track and a knotting station generally place all these items in close proximity. Conventionally, these components are mounted on a head in a fixed manner in order to insure durability, stability and economy of manufacture.

Cotton Industry Standards for the number of baling wires per bale is six or eight, six being the standard for the most commonly used bales. Known automatic balers have three heads mounted abreast on a carriage that translates. It is typical for these heads to be incorporated into a single carriage unit either by welding, machining or bolting, again for the purpose of strength, durability and ease of manufacture. Electro-servo motors, knotting stations and other components require periodic maintenance and occasional repair. The fixed mounting configurations of the present state of the art make such regular maintenance and repair difficult, time consuming, expensive and error prone.

There is a need in the art for a bracket head that will secure servo motors, knotters and tying stations in required configurations during operation while allowing for rapid and convenient repair and maintenance of those components.

SUMMARY OF THE INVENTION

The present invention is a tilt-out tying head. The tying head is that portion of a bracket assembly to which are fixed the necessary components for baling, including but not limited to a propulsion electro-servo motor, a knotter electro-servo motor, knotting mechanisms, cutters, tensioning grippers and, in some embodiments, limit switches. These components together, in cooperation with the ends of a guide track, comprise the tying head. The present invention is a tying head that tilts out and away from the parallel heads adjacent to it in order to provide easy access to the tying head components for maintenance and repair.

It is an object of this invention to make tying head component repair and maintenance easy, safe, rapid and economical.

DETAILED DESCRIPTION OF THE PREFERRED EMBODIMENTS

The Automatic Baler

Figure 1:
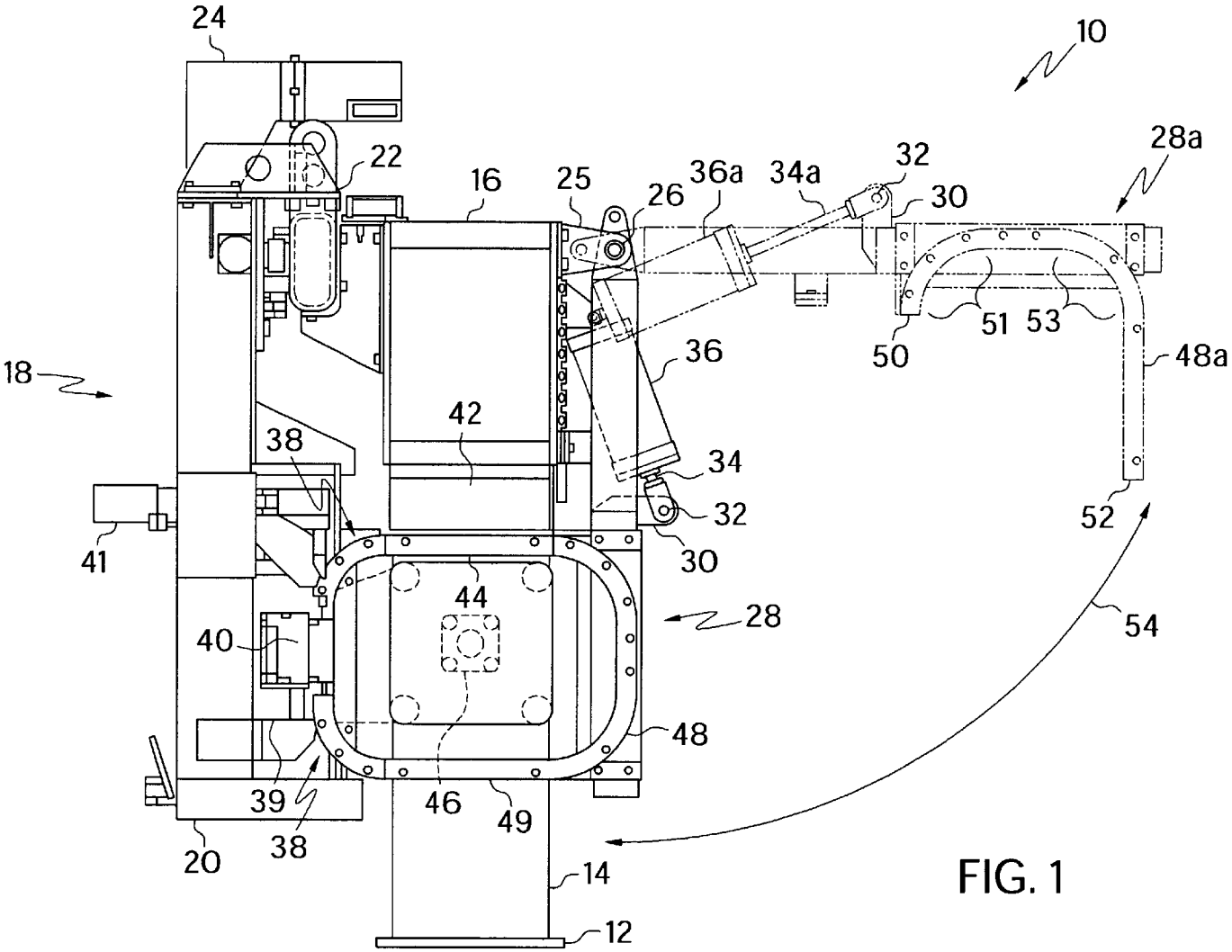
FIG. 1 is a side view of an automatic baler.

Referring to the accompanying drawings in which like reference numbers indicate like elements, FIG. 1 is a view of a conventional automatic baling machine. The bale binding apparatus, 10, is depicted to show two positions; the solid lines illustrate a first position wherein a moveable wire guide track section, 48, and moveable wire guide track section support strut assembly, 28, are in a first position to complete a wire guide track trajectory when bale binding is occurring; and the broken lines illustrate a second position wherein the moveable wire guide track section support strut assembly and moveable wire guide track section are removed to a second position, 28*a*. The second position allows ejection of the finished, bound bale. A third "ready" position, not shown, is between the two illustrated positions. In the "ready" position, the wire guide tracks are clear of the bale compressor, but not high enough to be clear of the ejector.

A floor plate, 12, supports vertical support stands, 14, on either side of the bale binding station, 46. A binding assembly carriage, 18, is born by stands, 14. The base extension, 20, of the carriage, 18, carries the fixed tying heads, 40, and attached fixed first section of wire guide track, 38. Extending from the upper forward extent of the stands, 14, are a pair of pivot axis brackets, 25, holding the pivot axes, 26, which carry the moveable guide track support strut assembly, 28. Extending forward from the center of the strut assembly, 28, is a member, 30, pivotally connected at pin, 32, to piston arm, 34, which is extended and withdrawn by action of the piston, 36. The action of the piston, 36, may be by any means but is preferably pneumatic.

The binding wire entering the apparatus 10 from the wire supply (not shown) at the wire control head 41 is directed by guide track sections 38 to and from the tying head 40 which fastens the wire into a closed loop. The guide track section 44 lies in a channel within the bale forming compressor 42 which accommodates the wire trajectory above the bale forming station 46 containing the bulk material (not depicted). The positions 28*a*, 34*a*, 36*a* and 48*a* show the parts 28, 34, 36 and 48 in their respective positions when the apparatus is in the arrangement whereby the movable guide track section is at a remove from the bale forming station 46. The upper movable guide track section terminus 50 and the lower movable guide track section terminus 52 meet the guide track sections 46 and 38 respectively to complete the wire guide track. The arctuate line 54 illustrates the path of motion of the lower terminus 52 as it transits between positions. Movable guide track section 48 has an upper curve 51 and a lower curve 53 both of approximately ninety degrees and possessing radii of curvature of approximately six inches and approximately seven inches, respectively.

In operation, when the movable guide track support strut assembly 28 is down, the binding wire entering the apparatus 10 from the wire supply (not shown) at the wire feed head 41. Feeder head drive wheels (not shown) rotate to push wire frictionally through the tying head 40 downward to the lower most guide track sections 38 and across, up, back, and then down the other guide track sections 38, and then back into tying head 40. The wire thus forms a loop section with an overlapping wire portion located within tying head 40.

Figure 2:
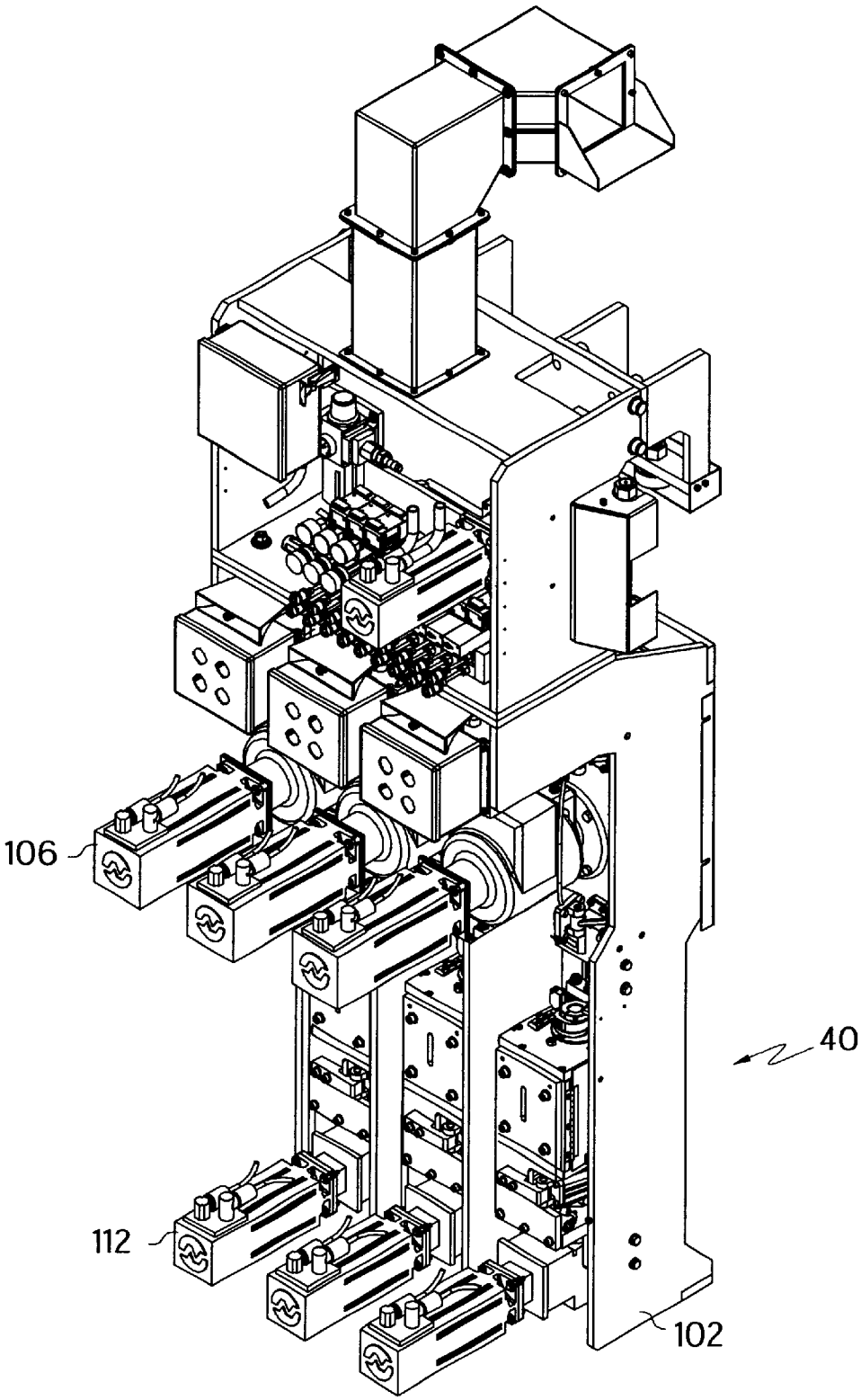
FIG. 2 is an oblique view of a three head carriage.
Figure 3:
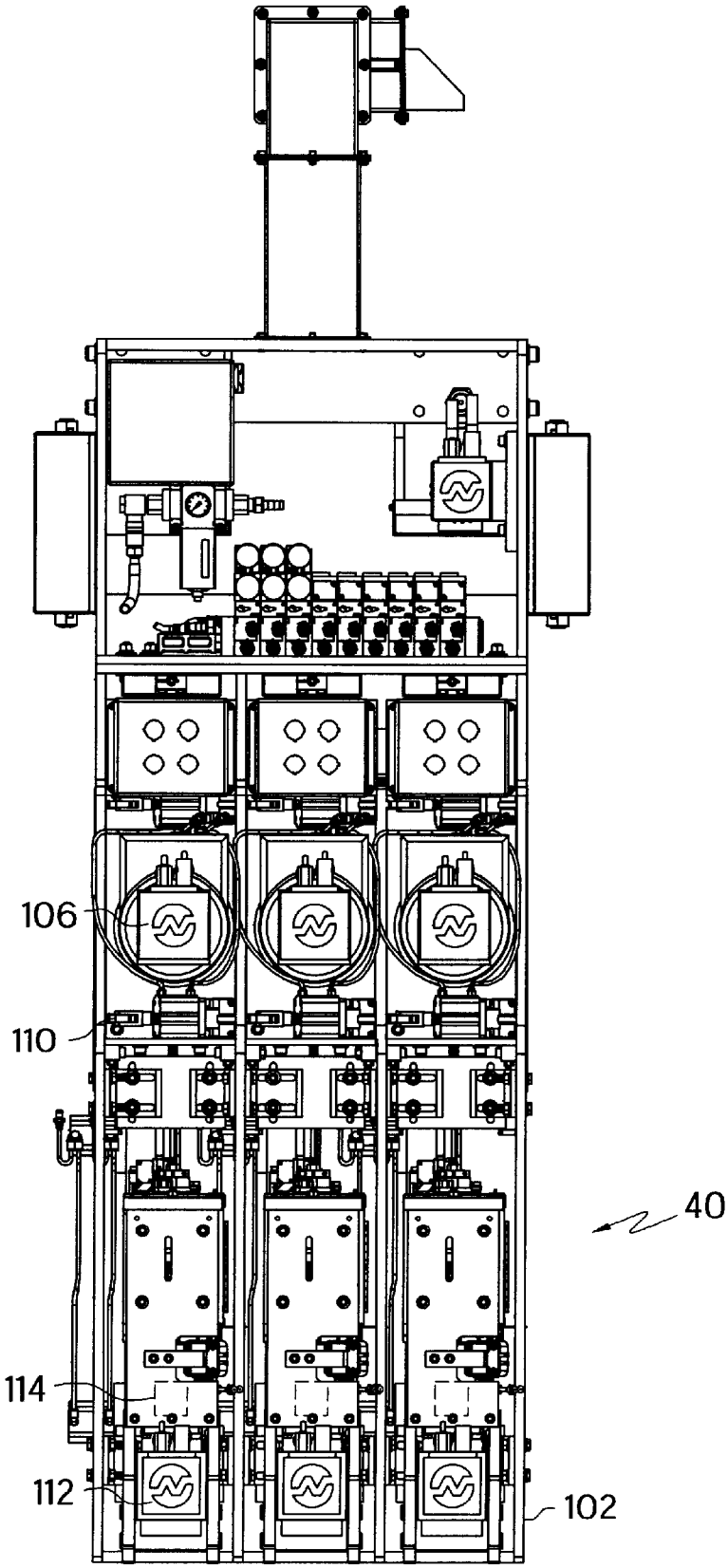
FIG. 3 is a front view of a three head carriage.
Figure 4:
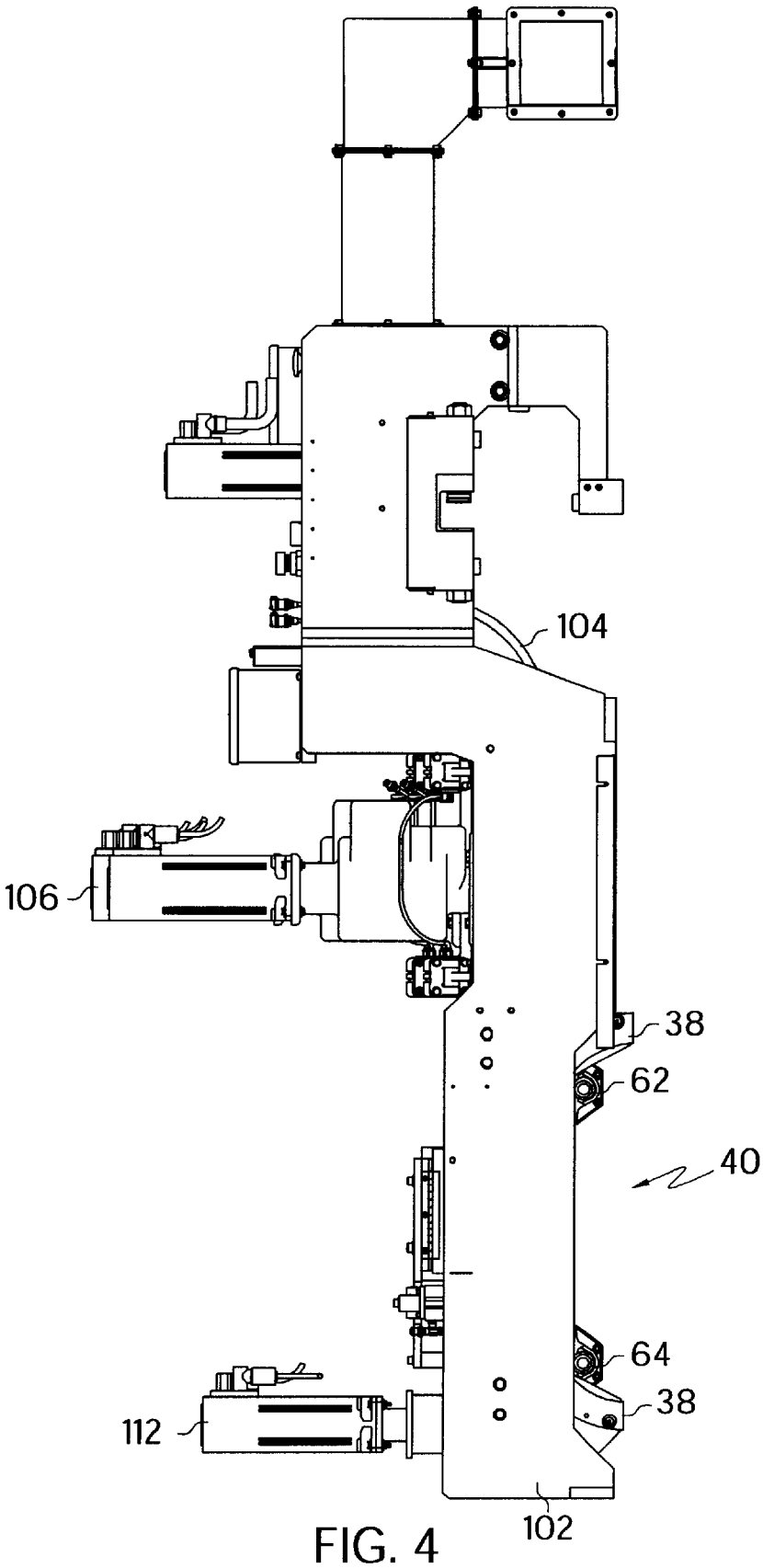
FIG. 4 is a side view of a three head carriage.

FIGS. 2, 3 and 4 are oblique, side and front views, respectively, of three tying heads mounted on a carriage. The preferred embodiment has six heads. Head walls 102 separate the components of a head from those of the adjacent head, and provide a mounting plate for By components. Baling wire enters the head from a wire dispensing station (not shown), through guide 104.

The drive wheels direct the progress of the bailing wire through the fastening station in front of the fastener head 40 and into a channel within a first, fixed section of wire guide track, 38. The first fixed section of wire guide track, 38, redirects the direction of the progressing bale wire from a downwards direction to a horizontal direction corresponding to a receiving end of a horizontal second section of guide track (not shown).

After its circuit through the wire guide track and around the bale, the baling wire reenters the head at upper fixed wire guide track section 38. The upper curved section of the wire guide track receives the progressing baling wire from an exit end of a horizontal previous section of wire guide track (not shown) and redirects it in a downward direction to enter fastening station 40. The drive wheels' servo motor 106 is signaled to stop either by a limit switch or, in the preferred embodiment, by reaching a terminal position pre-configured in the servo control system memory. A tensioning gripper (not shown) then extends to hold the distal end of the baling wire in a fixed position. The two tensioning pins, 62 and 64 extend into the plane of the bale wire loop. After gripping and holding the baling wire, a signal is sent to the drive wheels' servo motor to reverse direction whereupon the drive wheel pairs frictionally tension the baling wire in a direction opposite its original progression around the bale. Tensioning of the wire produces an inward pressure on the wire which is designed to be of sufficient strength to overcome the restraining lateral pressure holding the wire guide track longitudinal halves together. The bale wire is thereby pulled out of the guide track. The wire then comes into contact with the bale and tensioning pins.

Such tensioning is also required for proper operation of the fastener 40. Upon being sufficiently tensioned to exit the wire guide track, the ends of the wire are ready to be tied by the fastener.

The fastener must generate a knot which is compliant with industry standards for knot tension strength. The knot fastener is comprised of a tying servo motor 112 which drives a tying cylinder 114 (obscured) which rotates a predetermined amount, typically about 360°, and, through a gear reduction box, produces a number of twists in the baling wire ends, typically eight in number. After knotting, the wire is released and its proximal end is cut, both by conventional mechanical means.

Figure 5:
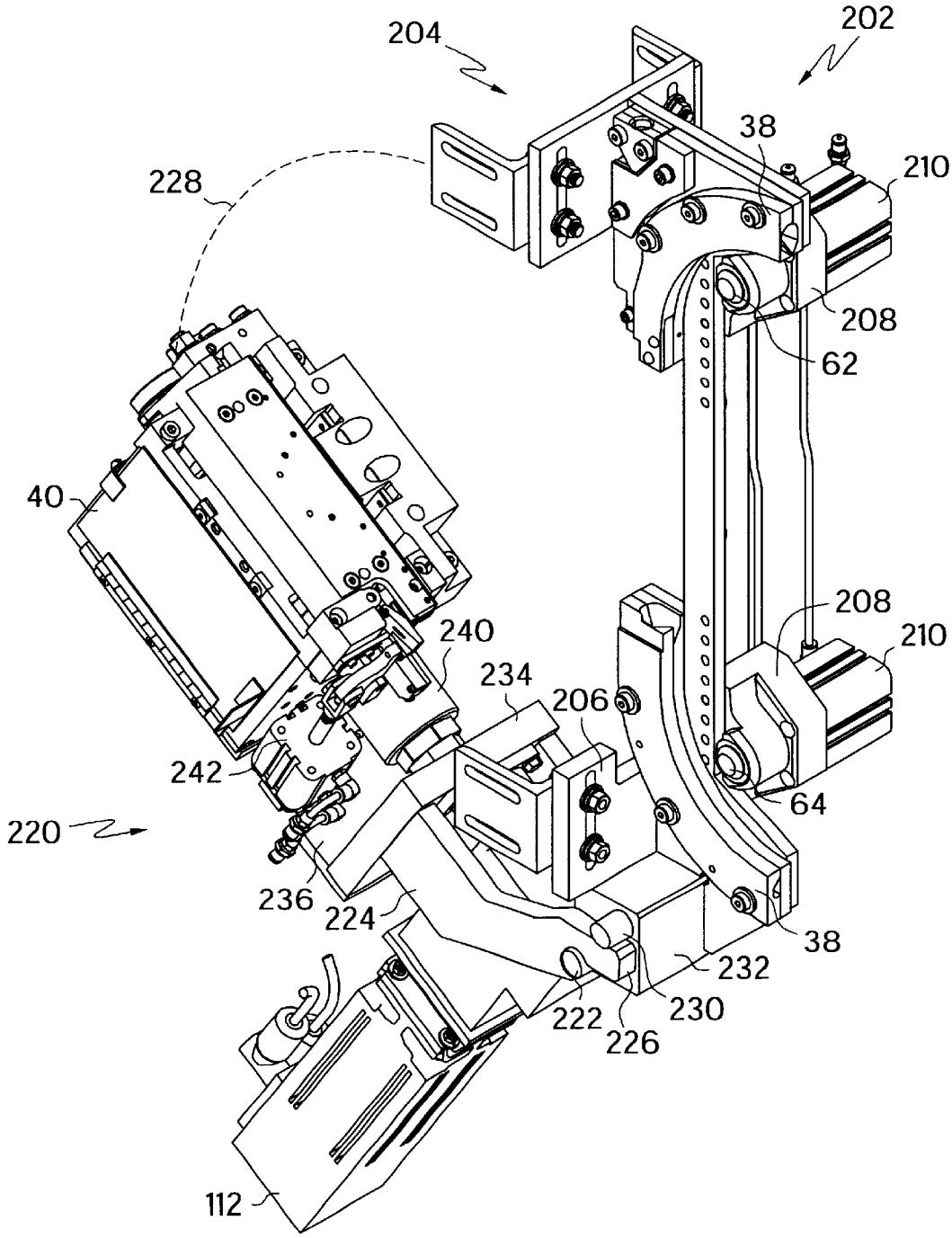
FIG. 5 is an oblique view of a tilt out tying head.

FIG. 5 is an oblique view of an isolated tying head incorporating the tilt out capability of the present invention. Fixed head assembly, 202, is bolted onto a carriage, (not shown), 20 upper mounting brackets, 204, and lower mounting brackets, 206, incorporate slots for adjustment of the fixed head position on the carriage. In alternative embodiments the fixed head may be otherwise fixed to a carriage, as by welding or machines, or fixed directly to a baler support frame. Tensioning pins, 62 and 64, tensioning pin mounting brackets, 208, and tensioning pin extension solenoids, 210, are bolted onto fixed head assembly, 202. First guide track section, 38, and last guide track section, 38, are also bolted onto the fixed head assembly, 202.

Tilt out head, 220, rides on pivot axis, 222. Pivot axis bracket, 224, may be open in its articulation with pivot axis, 222, as depicted in FIG. 5. In an alternative embodiment, pivot axis bracket, 224, may incorporate a closed hole completely encircling pivot axis, 222, upon insertion of pivot axis, 222, into said hole. In either case, pivot axis bracket, 224, has an extension, 226, which arrests the motion of the tilt out head. This motion is downward, outward and arcuate about the pivot axis, as indicated by broken lines, 228. The motion is to arrested when pivot axis bracket extension, 226, comes into contact with stop pin, 230, which is fixed to mounting block, 232, which is a part of fixed head assembly, 202. Stop pin, 230, also maintains the position of the tilt out head when it is down for repair or inspection purposes.

Alternatively or additionally, a cable of pre-determined length may be bolted to the tilt is out head, 220, and bracket wall, 102, as an equivalent arrest means.

The tilt out head, 220, incorporates a mounting platform, 234, and a mounting platform back, 236. FIG. 5 depicts the tilt out head equipped with a wire knotter mechanism, 40 and wire knotter electro servo motor, 112. Alternatively, the tilt out head of the present invention may be assembled in combination with equipment for strapping bulk material bales with plastic or metal straps instead of wire. In such an application, a strap propulsion electro servo motor, strap sealer mechanism and sealer mechanism electro servo motor would equivalently be located in substantially the same positions as the wire propulsion electro servo motor knotting mechanism, 40 and knotter electro servo motor, 112 depicted in FIG. 5.

The knotter assembly, 40, in combination with the knotter drive electro servo motor, 112, is mounted to the tilt out head mounting platform back, 236. The knotter cylinder, 240, is fixedly attached to the mounting platform, 234, in a manner that will allow it to rotate to effectuate knotting. The knotting cylinder solenoid, 242, is fixedly attached to the mounting platform back, 236. It will be appreciated by those of skill in the art that the pivot axis brackets, mounting platform, 234, mounting platform back, 236, may be variable in a configuration while still embodying the tilt out function of the present invention. It will further be appreciated by those of skill in the art that knotter, 40, knotting cylinder, 240, knotter propulsion electro servo, 112, and knotting cylinder actuator solenoid, 242, may all be mounted on the tilt out head of the present invention in a variety of configurations in order to perform the tilt out function of the present invention, and that all such configurations are contemplated to be within the scope of the present invention.

FIG. 5 depicts the tilt out head in its maintenance or repair position, that is, tilted out from its baling operation position. It will be appreciated by those of skill in the art that all the functional components of the tying head are readily accessible for repair and maintenance in the depicted down position of the tilt out head of the present invention in FIG. 5.

Figure 6:
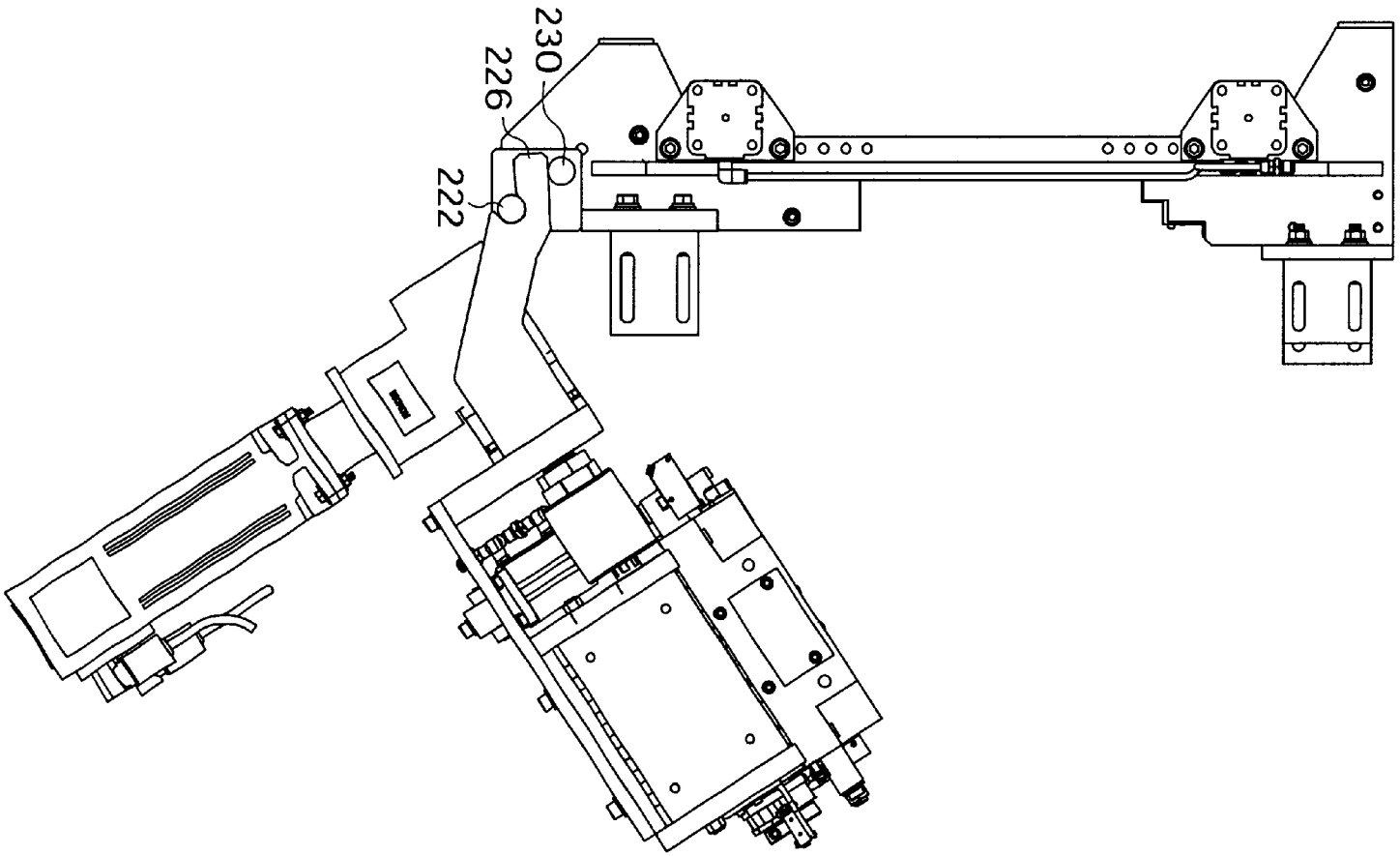
FIG. 6 is a side view of an open tilt out tying head.

FIG. 6 depicts a side view of the preferred embodiment of the present invention, in which the tilt out head is substantially identical to the previously depicted embodiments in the configuration of the component electro servo motor and knotting mechanisms. The mounting platform and mounting platform back are substantially identical to previously depicted embodiments.

The side view of the present invention depicted in FIG. 6 shows the pivot axis bracket, pivot axis, 222, pivot axis bracket extension, 226, that arrests the downward and outward arctuate motion of the tilt out head when it comes into contact with stop pin, 230.

Figure 7:
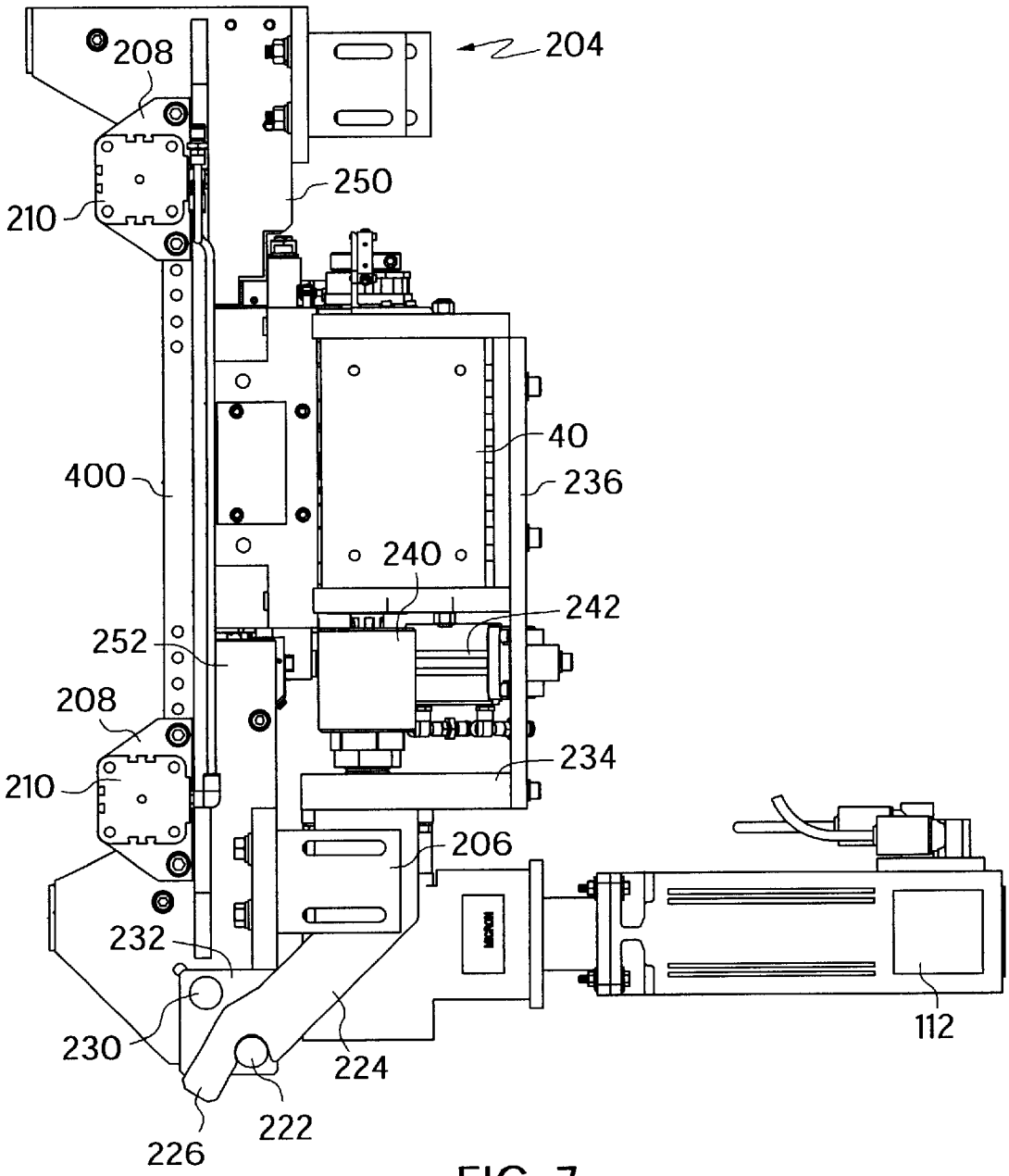
FIG. 7 is side view of a closed tilt out tying head.

FIG. 7 is a side view of the tilt out head of the present invention in its up, operating position. Head assembly is bolted onto a carriage. Upper mounting brackets, 204, and lower mounting brackets, 206, incorporating slots for adjustment of the fixed head position on the carriage, are attached to the carriage (not shown) by bolts (not shown). Tensioning pin extension solenoids, 210, and tensioning pin extension solenoid mounting brackets, 208, are fixedly attached to the tying head assembly. A first guide track section (not shown) is fixedly mounted to first guide track section mounting plate, 400. A last guide track section (not shown) is fixedly attached to a last guide track section mounting plate, 400.

Knotting mechanism, 40, is fixedly attached to tilt out head mounting platform back, 236. Knotting unit drive electro servo motor, 112, is fixedly attached to knotting cylinder, 240, which is fixedly attached to tilt out head knotting platform, 234, in a fashion that allows for its rotation during operation. Knotting cylinder actuator solenoid, 242, is fixedly attached to tilt out head mounting platform back, 236.

In the up position a substantial portion of the weight of the tying assembly and tilt out tying head is supported by the pivot axis, 222, in close cooperation and articulating support of the tilt out head pivot access bracket, 224, and pivot access bracket extension, 226. The pivot axis, 222, and stop pin, 230, are fixedly attached, by conventional methods such as welding or machining to the pivot access, to stop pin mounting block, 232, which in turn is a fixed portion of the fixed head assembly.

Figure 8:
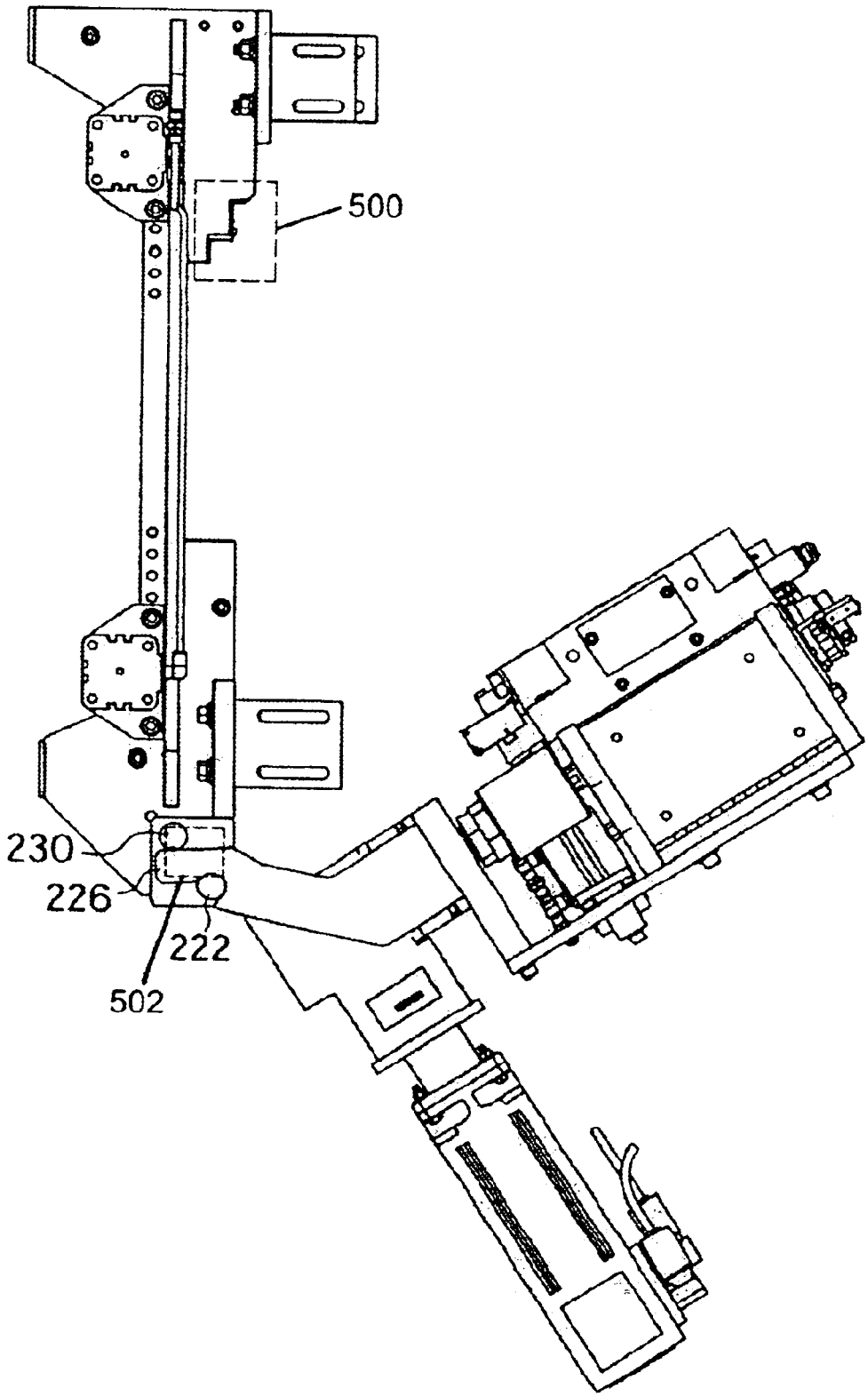
FIG. 8 is a side view of an open tilt out tying head.

The pivot axis 222 and pivot access bracket 224 of the tilt-out head act as a bracket travel mediator. As shown in FIG. 8, the travel bracket mediator 502 may be or include a pivot, a slide, a hinge, a lift, a cam, an axis and a lever (these are conventional features whose detailed illustration is not essential for a proper understanding of the invention). The stop pin 230 may be a pin, a latch, a cable, a bolt or any type of an abutment surface.

The tilt out head may also have a lock or other maintainer for maintaining it in a first position that is engaged with the rest of the baler for operation. As shown in FIG. 8, the first position maintainer 500 may be a latch, a clamp, a pin, a bolt, a cable or a magnet (these are conventional features whose detailed illustration is not essential for a proper understanding of the invention).

In operation, wire drive unit receives wire from a replaceable spool of wire (not shown). Through a drive mechanism, typically drive wheels (not shown), the wire is propelled towards the first guide track (not shown) where it is guided around the volume of bulk material to be baled (not shown) located to the left in FIGS. 6 and 7. Upon completion of its circuit around the volume of bulk material to be baled the advancing baling wire is received by a last guide track section (not shown) which guides the wire into the knotting mechanism, 40. At that point the knot is tied by the knotting mechanism, 40, as actuated by the knotter electro servo motor, 112, knotting cylinder, 240, and knotting cylinder actuator solenoid, 242. It will be appreciated by those of skill in the art that the knotting mechanism, 40, and propulsion mechanism, 112, are required to be positioned in close cooperation with the head assembly, and in particular an upper tilt out head receiving plate, 250, and lower tilt out head receiving plate, 252. It will further be appreciated by those of skill in the art that the tilt out head and its constituent components will be locked in the up position for operation by any of a variety of conventional locking means (not shown) including, but not limited to, pins, bolts, levers, catches or the like.

The term "strap" is a recognized industry term of art understood by those with skill in the art to mean generically wire, metal bands, plastic bands or other types of straps. The preferred embodiment of the present invention uses "straps" that are wire, most preferedly 10-guage wire. Those with skill in the art will understand from the use of the term "strap" that the scope of the present invention applies equivalently to both wire, metal bands, plastic bands and any other kind of binding strap used in bulk material baling.

In view of the foregoing, it will be seen that the several advantages of the invention are achieved and attained.

The embodiments were chosen and described in order to best explain the principles of the invention and its practical application to thereby enable others skilled in the art to best utilize the invention and various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A tilt-out head for a bulk material baling station comprising:

a bracket, said bracket being moveable from a first position engaged with said bulk material baling station to a second position removed from said bulk material baling station;

a strap fastener attached to said bracket;

a strap feed drive attached to said bracket; and a bracket travel mediator that controls the travel of said bracket from the first position to the second position.

2. The tilt-out head of claim 1 further comprising:

a first position maintainer, said first position maintainer securing said bracket with said strap fastener and said strap feed drive in the first position, said first position maintainer being releasable for moving said bracket to the second position.

3. The tilt-out head of claim 2 wherein said first position maintainer is selected from the group consisting of: a latch, a clamp, a pin, and a bolt.

4. The tilt-out head of claim 1 wherein said bracket travel mediator is a pivot, on an axis.

5. A tilt-out strap fastener head for a bulk material baler comprising:

a frame supporting said bulk material baler;

a bracket, said bracket being pivotally mounted to said frame and movable between a first position engaged with said bulk material baler and a second position removed from said bulk material baler;

a strap fastener attached to said bracket; and a strap feed drive attached to said bracket.

6. The tilt-out strap fastener head of claim 5 further comprising:

an engagement lock for holding said bracket, strap fastener and said strap feed drive in said first position engaged with said bulk material baler for baling.

7. The tilt-out strap fastener head of claim 6 wherein said lock is selected from the group consisting of: a latch, a clamp, a pin, and a bolt.

8. The tilt-out strap fastener head of claim 5 further comprising:

a travel stop for holding said bracket in said second, removed position for accessing said strap fastener and said strap feed drive.

9. The tilt-out strap fastener head of claim 8 wherein said travel stop is selected from the group consisting of: a stop pin, a latch, a cable, a bolt and an abutment surface.

10. The tilt-out strap fastener head of claim 5 further comprising a carriage moveably fixed to said frame and translatable between at least two registered positions, said bracket being pivotally attached to said carriage.

11. A tilt-out strap fastener head for a bulk material baler comprising:

a frame, said frame having a first surface;

a bracket, said bracket being moveable between a first, engaged position and a second, removed position, said bracket further having a second surface in close cooperation with said first surface on said frame;

a pivot axis fixedly attached to one of said first surface and said second surface;

a pivot axis collar fixedly attached to the other of said first surface and said second surface;

a strap fastener attached to said bracket;

a strap feed drive attached to said bracket; and whereby said strap fastener and said strap feed drive may be moved with said bracket from said first position to said second position for enabling access to said strap fastener and said strap feed drive.

12. The tilt-out strap fastener head of claim 11 further comprising an engagement lock for holding said bracket, said strap fastener and said strap feed drive in said first position engaged with said bulk material baler for baling.

13. The tilt-out head of claim 12 wherein said lock is selected from the group consisting of: a latch, a clamp, a pin, and a bolt.

14. The tilt-out strap fastener head of claim 11 further comprising a travel stop for holding said bracket in said second, removed position, for accessing said strap fastener and said strap feed drive.

15. The tilt-out strap fastener head of claim 14 wherein said travel stop is selected from the group consisting of: a stop pin, a latch, a cable, a bolt and an abutment surface.

16. A bulk material baling apparatus comprising:

a bale forming and binding station including a bale binding device, said binding device employing a strapping for binding a bale of bulk material contained within said bale forming and binding station, said binding device having a strap drive unit, a guide track, a strap fastener and a tilt-out head;

said binding device being adapted to receive the strapping through the strap drive unit, said strap drive unit adapted to impel the strapping through said guide track, said guide track adapted to direct the strapping in a trajectory surrounding the bale, said strap fastener, upon a length of the strapping completing a circuit of the surrounding trajectory, fastening the complete circuit length of the strapping into a closed loop about the bale; and said tilt out head further comprising a bracket and a bracket travel mediator, said bracket being moveable from a first position engaged with said bulk material baling station to a second position removed from the baling station, said strap fastener and said strap drive unit being fixedly attached to said bracket, and said bracket travel mediator controlling travel of said bracket from said first position to said second position.

* * * * *